US011432631B2

(12) United States Patent
Peng

(10) Patent No.: US 11,432,631 B2
(45) Date of Patent: Sep. 6, 2022

(54) HOLEY BAG WITH DETACHABLE DECORATION

(71) Applicant: PETERPOINT XIAMEN IMP. & EXP CO., LTD, Xiamen (CN)

(72) Inventor: Dongmiao Peng, Fujian (CN)

(73) Assignee: PETERPOINT XIAMEN IMP. & EXP CO., LTD, Xiamen (CN)

( * ) Notice: Subject to any disclaimer, the term of this patent is extended or adjusted under 35 U.S.C. 154(b) by 1019 days.

(21) Appl. No.: 16/074,620

(22) PCT Filed: Dec. 29, 2017

(86) PCT No.: PCT/CN2017/119775
§ 371 (c)(1),
(2) Date: Aug. 1, 2018

(87) PCT Pub. No.: WO2018/227937
PCT Pub. Date: Dec. 20, 2018

(65) Prior Publication Data

US 2019/0274405 A1 Sep. 12, 2019

(30) Foreign Application Priority Data

Jun. 12, 2017 (CN) ..... 201720678456.2

(51) Int. Cl.
*A45C 13/08* (2006.01)
*A45C 13/10* (2006.01)
*A45F 3/04* (2006.01)

(52) U.S. Cl.
CPC ..... *A45C 13/08* (2013.01); *A45C 13/1076* (2013.01); *A45F 3/04* (2013.01)

(58) Field of Classification Search
CPC ..... A45F 3/04; A45C 7/0077
(Continued)

(56) References Cited

U.S. PATENT DOCUMENTS 5,503,204 A * 4/1996 Byers ..... A45C 3/08 150/103
6,076,485 A * 6/2000 Peeples ..... A01K 1/0254 119/496

(Continued)

FOREIGN PATENT DOCUMENTS

CN 202262537 U 6/2012
CN 203986529 U 12/2014

(Continued)

OTHER PUBLICATIONS

Translation for CN_202262537 (Year: 2011).*

*Primary Examiner* — Valentin Neacsu
*Assistant Examiner* — Justin Caudill
(74) *Attorney, Agent, or Firm* — Muncy, Geissler, Olds & Lowe, P.C.

(57) ABSTRACT

Holey bag with a detachable decoration includes a bag body provided with a plurality of holes and the decoration provided with a decorative part and an installation part. The decoration is detachably assembled on the bag body through cooperation between the installation part and the holes. The decorative part is fixed in front of one hole. The bag body is provided with a bottom piece, a rear piece and a top cover piece connected to a left piece, a front piece and a right piece through a zipper. The bag has a small weight, is convenient to transport, carry and decorate. When the zipper is unfastened, the bottom piece, the rear piece and the top cover piece are separated from the left piece, the front piece and the right piece, so that the bag is unfolded to be planar, thus, greatly reducing a casing volume and further reducing transportation cost.

7 Claims, 3 Drawing Sheets

(58) Field of Classification Search
USPC ..... 190/107, 109
See application file for complete search history.

(56) References Cited

U.S. PATENT DOCUMENTS

| | | | | |
|---|---|---|---|---|
| 8,157,068 | B2 * | 4/2012 | Sapyta | A45C 7/0054 190/109 |
| 2006/0266603 | A1 * | 11/2006 | Godshaw | A45C 3/004 190/108 |
| 2014/0261933 | A1 | 9/2014 | Jones | |
| 2017/0134063 | A1 * | 5/2017 | Lee | H04M 1/185 |
| 2017/0202325 | A1 * | 7/2017 | Hodgson | A45C 7/0054 |
| 2018/0014614 | A1 * | 1/2018 | Marshall | A45C 7/0095 |

FOREIGN PATENT DOCUMENTS

| | | |
|---|---|---|
| CN | 204580197 U | 8/2015 |
| CN | 205040858 U | 2/2016 |

* cited by examiner

HOLEY BAG WITH DETACHABLE DECORATION

BACKGROUND OF THE INVENTION

Technical Field

The invention relates to the technical field of backpacks, in particular to a holey bag with a detachable decoration.

Description of Related Art

In the prior art, backpacks made from hard materials have the advantages of being constant in shape and not prone to deformation. However, these backpacks generally are heavy and inconvenient to transport and carry. Moreover, these backpacks are inconvenient to fold and compress, resulting in a large casing volume during transportation and a higher transportation cost. Furthermore, the hard surfaces of these backpacks cannot be decorated conveniently like backpacks made from soft materials, and consequentially, the appearance shape of these backpacks is constant.

BRIEF SUMMARY OF THE INVENTION

The main objective of the invention is to provide a holey bag which is provided with a detachable decoration, has a small weight, and is convenient to transport, carry and decorate.

The secondary objective of the invention is to provide a holey bag which is provided with a detachable decoration and can be unfolded to be planar to reduce a casing volume and transportation cost.

To realize the above objectives, the following technical solution is adopted by the invention.

A holey bag with a detachable decoration includes a bag body and the decoration. A plurality of holes are formed in the bag body. The decoration is provided with a decorative part and an installation part. The decoration is assembled on the bag body through the cooperation between the installation part and the holes. The decorative part is fixed in front of one hole to decorative the bag body.

The installation part is provided with an insert column and a clamp. The insert column has a thickness smaller than a diameter of the holes. The clamp is larger than the holes. The insert column has a front end fixed to the back side of the decorative part and a rear end connected to the clamp. By inserting the insert column of the installation part into one hole and clamping the clamp behind the corresponding hole, the decorative part is fixed in front of the corresponding hole, and thus, the decoration is detachably assembled on the bag body.

The decoration is provided with two installation parts. Insert columns of the two installation parts are connected through an inner clamping piece. The inner clamping piece is wrapped with the decorative part.

The holes are densely formed in a front piece, a left piece, a right piece, a top cover piece and straps of the bag body.

A bottom piece, a rear piece and a top cover piece of the bag body are connected to a left piece, a front piece and a right piece of the bag body through a zipper. Positioning assemblies are respectively disposed between the upper left portion of the rear piece and the upper portion of the left piece as well as between the upper right portion of the rear piece and the upper portion of the right piece. When the zipper is fastened, the bottom piece and the left side of the rear piece are connected to the left piece, the bottom piece and the right side of the rear piece are connected to the right piece, the left piece, the right piece and the front piece are covered with the top cover piece, and the rear piece is fixed between the left piece and the right piece by means of the positioning assemblies, so that the holey bag is formed. When the zipper is unfastened and the positioning assemblies are removed, the bottom piece, the rear piece and the top cover piece are separated from the left piece, the front piece and the right piece, so that the bag is folded to be planar.

Each positioning assembly is composed of a ribbon and a snap fastener, wherein one end of the ribbon is fixed to the upper left portion or upper right portion of the rear piece, and a male fastener and a female fastener of the snap fastener are respectively fixed to the other end of the ribbon and the upper portion of the left piece or the right piece.

The zipper is provided with a left zipper puller and a right zipper puller.

The bag body is made from EVA materials, and thus, the bag has a small weight and is soft, good in plasticity and convenient to transport and carry.

By adoption of the technical solution that the bag body is provided with the holes, the bag has a small weight and is convenient to transport and carry. Furthermore, the decoration can be conveniently assembled and disassembled through the holes to decorate the bag body and to enrich the appearance shape of a backpack. In addition, the bottom piece, the rear piece and the top cover piece of the bag body are connected to the left piece, the front piece and the right piece of the bag body through the zipper, so that the bag is unfolded to be planar, thus, greatly reducing a casing volume and further reducing a transportation cost.

DESCRIPTION OF THE REFERENCE SIGNS

Figure 1:
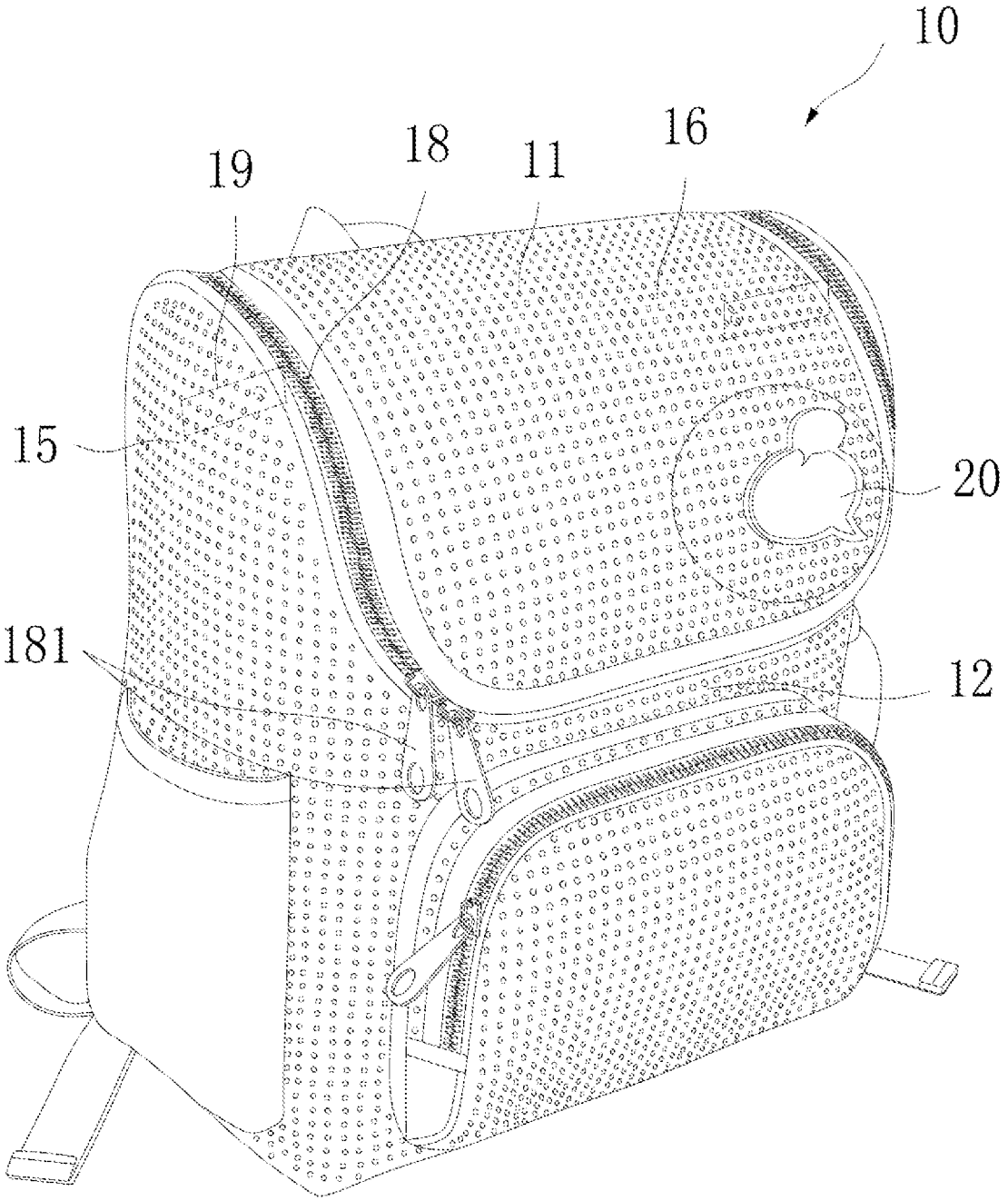
FIG. 1 is a perspective view of the invention.

Bag body 10, hole 11, front piece 12, rear piece 13, strap 131, left piece 14, right piece 15, top cover piece 16, bottom piece 17, zipper 18, zipper puller 181, positioning assembly 19, ribbon 191, male fastener 192, female fastener 193; decoration 20, decorative part 21, installation part 22, insert column 221, clamp 222, inner clamping piece 23.

DETAILED DESCRIPTION OF THE INVENTION

Figure 2:
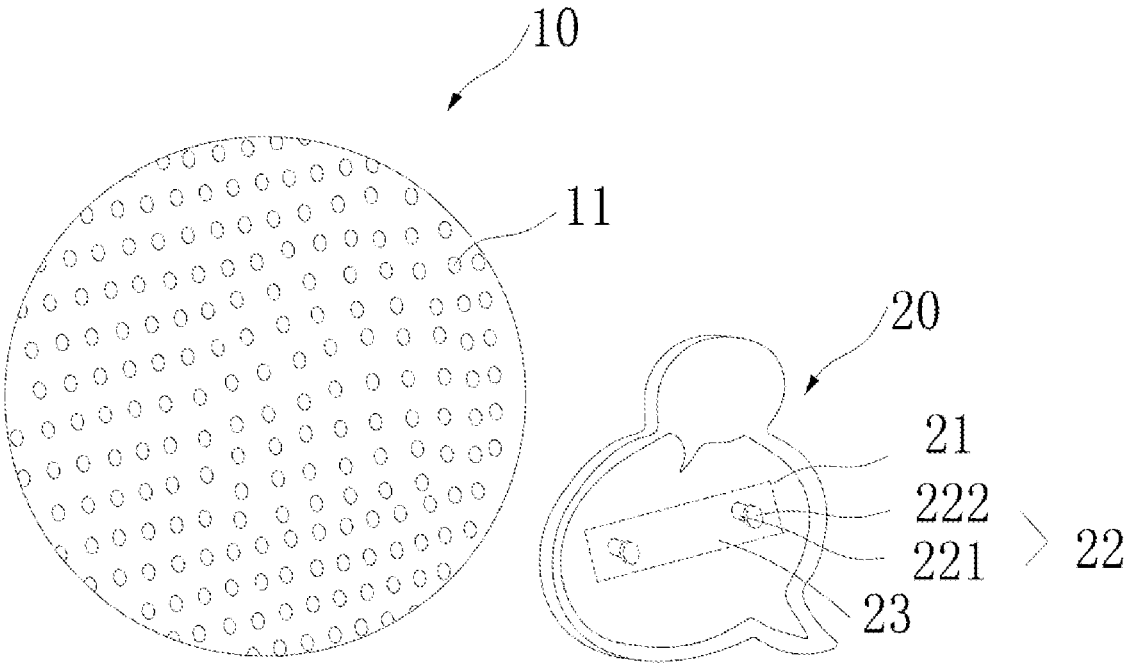
FIG. 2 is a partially enlarged view of the invention.
Figure 3:
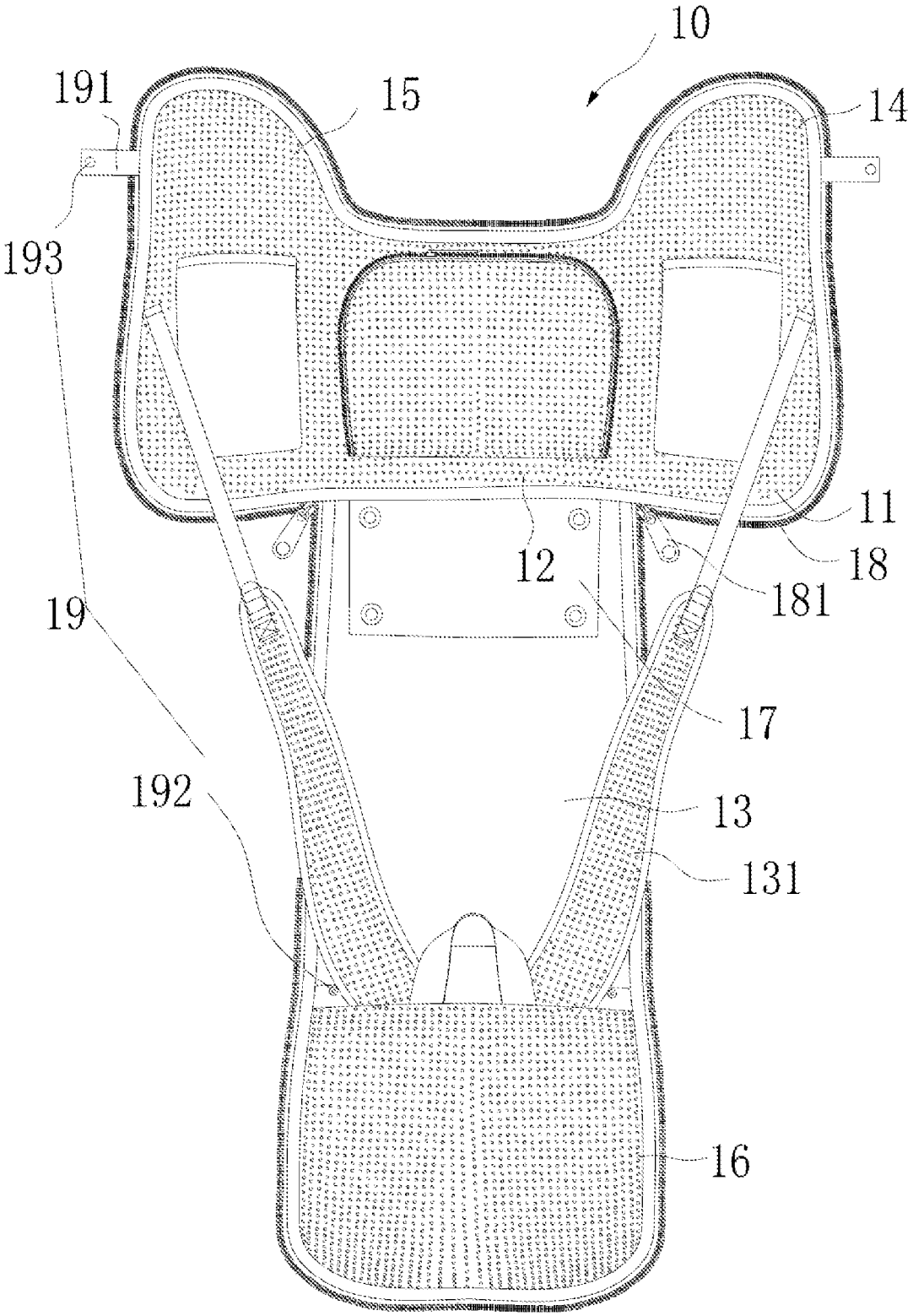
FIG. 3 is an unfolded view of the invention (without a decoration).

As shown in FIGS. 1-3, the invention discloses a holey bag with a detachable decoration. The holey bag with the detachable decoration includes a bag body 10 and the decoration 20.

A plurality of holes 11 are formed in the bag body 10. Specifically, as shown in the figures, holes 11 are densely formed in a front piece 12, a left piece 14, a right piece 15, a top cover piece 16 and straps 131 of the bag body 10, and a rear piece 13 and a bottom piece 17 may be provided with or may be not provided with holes, so that the holey bag of the invention has a small weight and is convenient to transport and carry, and the breathability of the bag is improved by the holes 11 in the straps 131. However, the bag body 10 is not limited to the bag form shown in the figures and can be in various forms according to design requirements, for instance, the bag body 10 may be transformed into a handbag, a trolley case or the like. The bag body 10 may be further made from EVA materials to make a backpack more portable.

The decoration 20 is provided with a decorative part 21 and an installation part 22. The decoration 20 is detachably assembled on the bag body 10 through the cooperation between the installation part 22 and the holes 11. The decorative part 21 is fixed in front of the holes 11 to decorate the bag body 10. Users may select personalized decorations 20 according to personal preferences to greatly enrich the appearance shape of the backpack. In order to assemble and disassemble the decoration 20 conveniently, the installation part 22 of the invention is provided with an insert column 221 and a clamp 222. The insert column 221 has a thickness smaller than a diameter of the holes 11, and the clamp 222 is larger than the holes 11. The front end of the insert column 221 is fixed to the back side of the decorative part 21, and the rear end of the insert column 221 is connected to the clamp 222. By inserting the insert column 221 of the installation part 22 into one of the holes and clamping the clamp 222 behind the corresponding hole 11, the decorative part 21 is fixed in front of the corresponding hole 11 and thus, the decoration 22 is detachably assembled on the bag body 10. For a decoration 20 with a large size, two (or even more) installation parts 22 can be adopted, the insert columns 221 of the two installation parts 22 are connected through an inner clamping piece 23, and the inner clamping piece 23 is wrapped with the decorative part 21 and used to better support the decorative part 21 so as to maintain a decoration effect.

Furthermore, the bottom piece 17, the rear piece 13 and the top cover piece 16 of the bag body 10 are connected to the left piece 14, the front piece 12 and the right piece 15 of the bag body 10 through a zipper 18. In order to open and close the bag conveniently, the zipper 18 is provided with a left zipper puller 181 and a right zipper puller 181. A positioning assembly 19 is disposed between the upper left portion of the rear piece 13 and the upper portion of the left piece 14. Another positioning assembly 19 is disposed between the upper right portion of the rear piece 13 and the upper portion of the right piece 15. The positioning assemblies 19 are used to fix the rear piece 13, the left piece 14 and the right piece 15 of the bag. Each positioning assembly 19 is specifically composed of a ribbon 191 and a snap fastener (including a male fastener 192 and a female fastener 193), wherein one end of the ribbon 191 is fixed to the left side (or right side) of the rear piece 13, the female fastener 193 of the snap fastener is fixed to the other end of the ribbon 191, and the male fastener 192 is fixed to the upper portion of the left piece 14 (or the right piece 15).

When the zipper 18 is fastened, the bottom piece 17 and the left side of the rear piece 13 connected to the left piece 14, the bottom piece 17 and the right side of the rear piece 13 are connected to the right piece 15, the left piece 14, the right piece 15 and the front piece 12 are covered with the top cover piece 16, and the rear piece 13 is fixed between the left piece 14 and the right piece 15 by means of the positioning assemblies 19, so that the holey bag used to store articles is formed, as shown in FIG. 1.

When the zipper 18 is unfastened and the positioning assemblies 19 are removed, the bottom piece 17, the rear piece 13 and the top cover piece 16 are separated from the left piece 14, the front piece 12 and the right piece 15, so that the bag is unfolded to be planar, as shown in FIG. 3, and thus, the casing volume is greatly reduced, and the transportation cost is further reduced.

What is claimed is:

1. A holey bag with a detachable decoration, including a bag body and the decoration, wherein a plurality of holes are formed in the bag body, the decoration is provided with a decorative part and an installation part, the decoration is detachably assembled on the bag body through cooperation between the installation part and the holes, and the decorative part is fixed in front of one said hole, wherein a bottom piece, a rear piece and a top cover piece of the bag body are connected to a left piece, a front piece and a right piece of the bag body through a zipper, and positioning assemblies are respectively disposed between an upper left portion of the rear piece and an upper portion of the left piece as well as between an upper right portion of the rear piece and an upper portion of the right piece; when the zipper is fastened, the bottom piece and a left side of the rear piece are connected to the left piece, the bottom piece and a right side of the rear piece are connected to the right piece; and the left piece, the right piece and the front piece are covered with the top cover piece, and the rear piece is fixed between the left piece and the right piece by means of the positioning assemblies, so that the holey bag is formed; and when the zipper is unfastened and the positioning assemblies are removed, the bottom piece, the rear piece and the top cover piece are separated from the left piece, the front piece and the right piece, so that the bag is unfolded to be planar.

2. The holey bag with the detachable decoration according to claim 1, wherein the installation part is provided with an insert column and a clamp, the insert column has a thickness smaller than a diameter of the holes, the clamp is larger than the holes, the insert column has a front end fixed to a back side of the decorative part and a rear end connected to the clamp, and by inserting the insert column of the installation part into one said hole and clamping the clamp behind the corresponding hole, the decorative part is fixed in front of the corresponding hole.

3. The holey bag with the detachable decoration according to claim 1, wherein the decoration is provided with two installation parts, insert columns of the two installation parts are connected through an inner clamping piece, and the inner clamping piece is wrapped with the decorative part.

4. The holey bag with the detachable decoration according to claim 1, wherein the holes are densely formed in a front piece, a left piece, a right piece, a top cover piece and straps of the bag body.

5. The holey bag with the detachable decoration according to claim 1, wherein each said positioning assembly is composed of a ribbon and a snap fastener, each said ribbon has an end fixed to the left side or right side of the rear piece, and a male fastener and a female fastener of each said snap fastener are respectively fixed to an end of the corresponding ribbon and an upper portion of the left piece or the right piece.

6. The holey bag with the detachable decoration according to claim 1, wherein the zipper is provided with a left zipper puller and a right zipper puller.

7. The holey bag with the detachable decoration according to claim 1, wherein the bag body is made from EVA materials.

* * * * *